US009017156B2

(12) United States Patent
Davledzarov

(10) Patent No.: US 9,017,156 B2
(45) Date of Patent: Apr. 28, 2015

(54) AIR CONTROL MODULE

(75) Inventor: Farhad Davledzarov, Westfield, MA (US)

(73) Assignee: Mestek, Inc., Westfield, MA (US)

( * ) Notice: Subject to any disclaimer, the term of this patent is extended or adjusted under 35 U.S.C. 154(b) by 402 days.

(21) Appl. No.: 12/913,939

(22) Filed: Oct. 28, 2010

(65) Prior Publication Data

US 2011/0100033 A1 May 5, 2011

Related U.S. Application Data

(60) Provisional application No. 61/256,377, filed on Oct. 30, 2009.

(51) Int. Cl.
*F24F 11/00* (2006.01)
*F24F 13/14* (2006.01)
*F24F 13/24* (2006.01)

(52) U.S. Cl.
CPC ..... *F24F 11/0076* (2013.01); *F24F 13/1426* (2013.01); *F24F 2013/1433* (2013.01); *F24F 2013/1473* (2013.01); *F24F 13/24* (2013.01)

(58) Field of Classification Search
CPC ..... F24F 11/0001; F24F 13/10
USPC ..... 454/239, 238, 333
See application file for complete search history.

(56) References Cited

U.S. PATENT DOCUMENTS 1,767,869 A * 6/1930 Baumgarten ..... 454/344
2,224,705 A * 12/1940 Stringer ..... 126/285 B
2,856,484 A * 10/1958 Fairbanks ..... 335/180
2,971,451 A * 2/1961 Feig ..... 126/299 D
3,060,833 A * 10/1962 Pledger ..... 126/299 F
3,791,281 A * 2/1974 Steiner ..... 454/350
3,945,565 A * 3/1976 Lynch et al. ..... 236/49.4
4,017,024 A * 4/1977 Grostick et al. ..... 236/1 G
4,204,833 A * 5/1980 Kmetz et al. ..... 431/22
4,295,632 A * 10/1981 Engelke ..... 251/127
4,327,869 A * 5/1982 Nawa et al. ..... 239/590.5
4,468,171 A * 8/1984 Katsumata et al. ..... 417/53
4,487,510 A * 12/1984 Buurman et al. ..... 366/337
4,549,362 A * 10/1985 Haried ..... 34/395
4,556,172 A * 12/1985 Sugawara et al. ..... 239/590.5
4,646,531 A * 3/1987 Song ..... 62/187
4,969,508 A * 11/1990 Tate et al. ..... 165/209
5,004,149 A * 4/1991 Narikiyo et al. ..... 236/49.3
5,039,006 A * 8/1991 Habegger ..... 236/11
5,251,815 A * 10/1993 Foye ..... 236/49.3
5,259,411 A * 11/1993 Guzorek ..... 137/527.8
5,398,728 A * 3/1995 Baumeister et al. ..... 138/37
5,449,112 A * 9/1995 Heitman et al. ..... 236/49.3
5,772,501 A * 6/1998 Merry et al. ..... 454/256
5,778,694 A * 7/1998 Jeong ..... 62/187
5,829,267 A * 11/1998 Fromm et al. ..... 62/404

(Continued)

OTHER PUBLICATIONS

ASHRAE Handbook, 2007.*

(Continued)

*Primary Examiner* — Steven B McAllister
*Assistant Examiner* — Jonathan Cotov
(74) *Attorney, Agent, or Firm* — McCormick, Paulding & Huber LLP

(57) ABSTRACT

A damper blade is moved within an air control module connected to the discharge of a high-velocity blower, thereby modulating the electric power consumption of the blower motor.

7 Claims, 6 Drawing Sheets

(56) References Cited

U.S. PATENT DOCUMENTS

| | | | | |
|---|---|---|---|---|
| 5,833,529 | A * | 11/1998 | Jacob | 454/61 |
| 5,857,617 | A * | 1/1999 | Weng | 236/49.3 |
| 6,213,117 | B1 * | 4/2001 | Kirk et al. | 126/285 R |
| 6,612,542 | B2 * | 9/2003 | Hirota et al. | 251/129.12 |
| 6,708,949 | B2 * | 3/2004 | Twito | 251/305 |
| 6,892,745 | B2 * | 5/2005 | Benson | 137/1 |
| 7,010,363 | B2 * | 3/2006 | Donnelly et al. | 700/19 |
| 7,188,481 | B2 * | 3/2007 | DeYoe et al. | 62/115 |
| 7,231,780 | B2 * | 6/2007 | Park | 62/408 |
| 7,533,691 | B2 * | 5/2009 | Marcoux et al. | 137/523 |
| 2002/0153729 | A1 * | 10/2002 | Beauchamp et al. | 290/55 |
| 2003/0077997 | A1 * | 4/2003 | Shideler | 454/75 |
| 2003/0121513 | A1 * | 7/2003 | McCarren | 126/504 |
| 2003/0157875 | A1 * | 8/2003 | Horner et al. | 454/74 |
| 2003/0163999 | A1 * | 9/2003 | Bennett et al. | 62/186 |
| 2003/0190885 | A1 * | 10/2003 | Johnsons, Jr. | 454/186 |
| 2004/0069249 | A1 * | 4/2004 | Kemp et al. | 122/505 |
| 2004/0154615 | A1 * | 8/2004 | Komano et al. | 126/629 |
| 2004/0185770 | A1 * | 9/2004 | Soeholm et al. | 454/239 |
| 2004/0209564 | A1 * | 10/2004 | Desai | 454/56 |
| 2005/0258259 | A1 * | 11/2005 | Stanimirovic | 236/49.1 |
| 2007/0023533 | A1 * | 2/2007 | Liu | 236/1 C |
| 2007/0178824 | A1 * | 8/2007 | Votaw et al. | 454/290 |
| 2007/0221199 | A1 * | 9/2007 | Hake et al. | 126/299 R |
| 2008/0051024 | A1 * | 2/2008 | Caliendo et al. | 454/369 |
| 2008/0119126 | A1 * | 5/2008 | Shizuo et al. | 454/75 |
| 2008/0135635 | A1 * | 6/2008 | Deng et al. | 236/44 C |
| 2008/0264088 | A1 * | 10/2008 | Hirsch et al. | 62/236 |
| 2009/0124191 | A1 * | 5/2009 | Van Becelaere | 454/359 |
| 2009/0209195 | A1 * | 8/2009 | Fincher et al. | 454/333 |
| 2009/0305627 | A1 * | 12/2009 | Joneleit | 454/333 |
| 2010/0082162 | A1 * | 4/2010 | Mundy et al. | 700/277 |
| 2010/0253270 | A1 * | 10/2010 | Kuster et al. | 318/452 |
| 2010/0291853 | A1 * | 11/2010 | Koshobu | 454/155 |
| 2011/0100033 | A1 * | 5/2011 | Davledzarov | 62/89 |
| 2011/0239915 | A1 * | 10/2011 | Ferri et al. | 110/261 |
| 2011/0287707 | A1 * | 11/2011 | Baik | 454/333 |
| 2011/0320045 | A1 * | 12/2011 | Salsbury et al. | 700/276 |
| 2012/0171949 | A1 * | 7/2012 | Baik | 454/333 |

OTHER PUBLICATIONS

American Society of Heating, Refrigerating, and Air-Conditioning Engineers (ASHRAE) Handbook (2007).*

* cited by examiner

AIR CONTROL MODULE

CROSS REFERENCE TO RELATED APPLICATIONS

The present application claims priority to U.S. Provisional Patent App. Ser. No. 61/256,337 filed Oct. 30, 2009, and hereby incorporates herein by reference the disclosures thereof.

FIELD OF THE INVENTION

The present invention relates to "central air" installations of heating-ventilation-air-conditioning (HVAC) equipment and, more particularly, to an apparatus and method for regulating the operation of a small-duct, high-velocity HVAC unit.

BACKGROUND OF THE INVENTION

"Central air" has become a widely desired mode of heating, ventilation, and air-conditioning. To provide central air, an HVAC (heating-ventilation-air-conditioning) unit is installed into a house or other building. HVAC unit installations typically are designed to handle the largest expected heating or cooling/conditioning load throughout a yearly temperature cycle. Thus, for a large part of any year in any given installation, the installed HVAC unit is over-rated for the actual required heating or cooling load.

Referring to FIG. 1, a conventional HVAC unit 2 installed into a building 4 includes a compressor 6, a condenser 8, an expansion valve 10, and an evaporator 12, arranged within a housing 14 to provide a vapor-compression refrigeration system for heating, cooling, and/or conditioning the air. The conventional HVAC unit also includes a blower 16 disposed to ventilate air from an inlet 18 of the housing across either of the condenser and the evaporator for heating, cooling, and/or conditioning the air, as well known in the art. Those of ordinary skill will appreciate that other modes of air conditioning system also can be used within the HVAC unit, for example evaporative or absorption systems, and that with the refrigeration system secured the HVAC unit can be used as a ventilation unit. The housing also includes an outlet 20 to which ductwork or a plenum 22 can be attached for conveying conditioned air from the HVAC unit throughout the building. Typically, the HVAC unit includes a motor control board 24 for regulating operation of the blower and of the compressor according to the quantity of conditioned air required in the building. As discussed above, the blower and the compressor typically are over-rated, that is, the HVAC unit only needs to run part time at full capacity in order to handle the typical heating or cooling load of the building.

Referring to FIG. 2, the motor control board 24 typically includes one or more relays 26 for selectively providing electric current to the motors of the compressor and the blower, input jacks 28 for receiving sensor data and control signals, a processor 30, and one or more data storage structures 31 (such as, by way of example, PROM, EEPROM, or flash memory chips or capacitors) for storing data and/or control signals. The processor is electrically connected to the relays and to the input jacks for controlling the relays based on data and signals received from the input jacks or from the data storage structure(s).

Conventionally, the processor 30 on the motor control board 24 is configured to cycle the relays 26 on or off based on the sensor data and control signals, according to well-known algorithms for cyclic control of HVAC equipment. In some HVAC units, the relays are configured as pulse-width-modulation (PWM) circuits, and the processor can be configured to control the blower 16 and/or the compressor 6 by modulating electric voltage and/or current provided to the motors of the compressor and the blower according to other well-known algorithms. Two goals of cyclic or modulated blower and compressor control are to enhance the comfort of building occupants while minimizing consumption of electric current by the HVAC unit 2.

Regulating operation of the HVAC unit 2 by cycling electric current to the blower motor and the compressor motor results in intermittent, start-and-stop transient type operation. Mechanical, electrical, and thermal transients during startup and shutdown are major factors in determining the operative lifetime of an HVAC unit. Additionally, startup and shutdown are the noisiest phases of operation for a typical HVAC unit. Thus, for a large part of any given year, an installed HVAC unit controlled by cycling electric current will present undesirable noise.

Regulating operation of the HVAC unit 2 by modulating electric voltage and/or current to the blower motor and/or the compressor motor results in operating the motors at less than optimal efficiencies, causing undesirable consumption of electrical power and generation of waste heat.

Accordingly, it is desirable to regulate electric power consumption of the HVAC unit to match actual heating or cooling loads, without causing unduly noisy operation or adversely affecting the electrical efficiency of the HVAC unit.

SUMMARY OF THE INVENTION

According to the present invention, electric current consumption by a high-velocity blower motor is mechanically modulated by selectively restricting volumetric airflow through the HVAC unit.

In an embodiment of the present invention, an air control module connected between a high velocity blower and a distribution plenum selectively restricts volumetric airflow through the blower to provide mechanical modulation of electric current consumption by the blower motor. In one aspect of the present invention, the air control module includes a movable damper blade. The damper blade can be moved by an actuator in response to a command signal provided by an HVAC unit control board.

In an embodiment of the present invention, a mechanically-modulated ventilation unit apparatus includes a high-velocity blower having an intake, an exhaust, an impeller disposed to ventilate air from the intake to the exhaust, and an electric motor operatively connected to drive the impeller. The ventilation unit apparatus also includes an air control module with a casing enclosing a flow passage that defines a flow axis extending from an inlet flange of the casing to an outlet flange of the casing. The air control module has a blade pivotally mounted within the casing and movable between a plurality of positions each obstructing a different portion of the flow passage, and also has an actuator operatively connecting the blade to the casing for moving the blade to one of the plurality of positions in response to a command signal received at the actuator. The air control module and the blower are arranged such that the blower ventilates the flow passage. Electric power consumption by the electric motor of said high-velocity blower is modulated solely by movement of the blade within said air control module.

According to the present invention, a method for mechanically modulating electric power consumption of a blower motor associated with a ventilation unit includes determining in a processor a volumetric airflow requirement based on sensor data and on at least one control signal related to the sensor data, and selecting for a damper blade associated with the ventilation unit a modulated flow position corresponding to the volumetric airflow requirement. The method further includes generating in the processor a command signal corresponding to the modulated flow position, and adjusting the damper blade in response to the command signal, thereby modulating electric power consumption of the blower motor.

In an embodiment of the present invention, a noise-reducing air control module apparatus includes a casing enclosing a passage for high-velocity airflow, and a damper blade movable within the casing for varying a flow area of the passage enclosed by the casing. The broadest surface of the damper blade has a generally rectangular shape with at least one rounded corner, the at least one rounded corner defining a removed area such that, with the damper blade positioned generally across the passage enclosed by the casing, the damper blade obstructs no more than about eighty-four percent (84%) of the flow passage. The apparatus further includes a processor configured to receive sensor data and to generate a command signal based on parameters including at least the received sensor data and at least one control signal related to the received sensor data. The processor is in communication with an actuator that is operably connected between the damper blade and the casing for adjusting the damper blade to vary the flow area of the passage in response to the generated command signal. The command signal represents a modulated flow position of the damper blade selected from a range of positions between a maximum-flow position and a minimum-flow position.

These and other objects, features and advantages of the present invention will become apparent in light of the detailed description of the best mode embodiment thereof, as illustrated in the accompanying drawings.

DETAILED DESCRIPTION OF PREFERRED EMBODIMENTS

Figure 1:
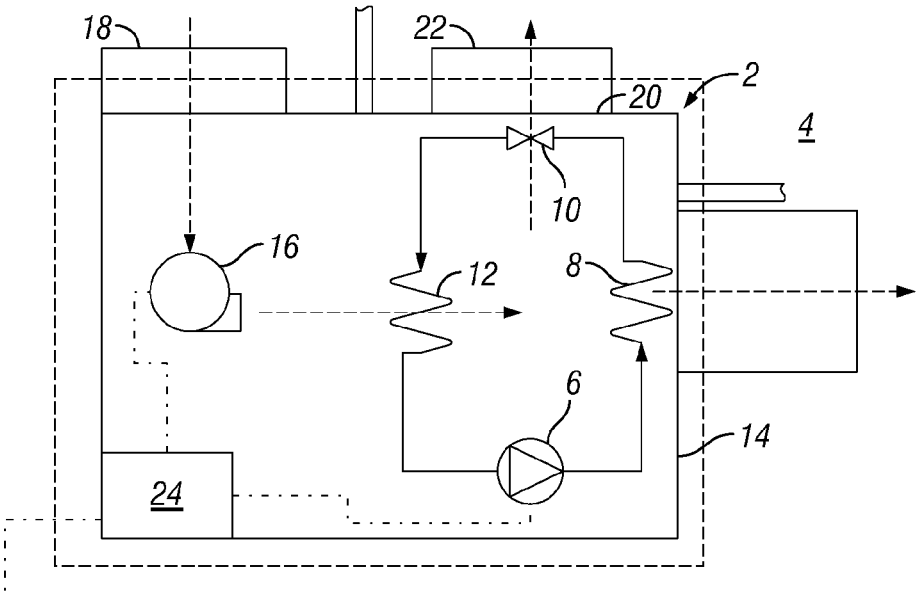
FIG. 1 (Prior Art)
FIG. 1 is a schematic illustration of a conventional "central air" HVAC system.
Figure 3:
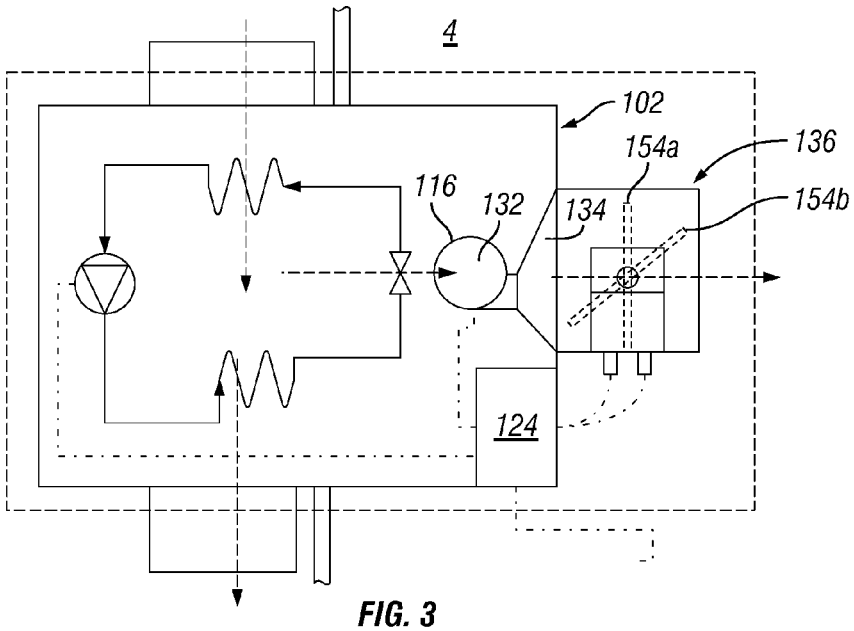
FIG. 3 is a schematic illustration of a small-duct, high-velocity HVAC system including an airflow control board and an air control module, according to an embodiment of the present invention.

Referring to FIG. 3, wherein like components have like numbers to those components described above with reference to FIG. 1, a high-velocity HVAC unit 102 includes a high-velocity blower 116 having an inlet 132 and an outlet 134, a compressor, a condenser, an expansion valve, an evaporator, a housing, an airflow control board 124, and a small-duct air control module 136 attached directly to the outlet 134 of the high-velocity blower.

Figure 2:
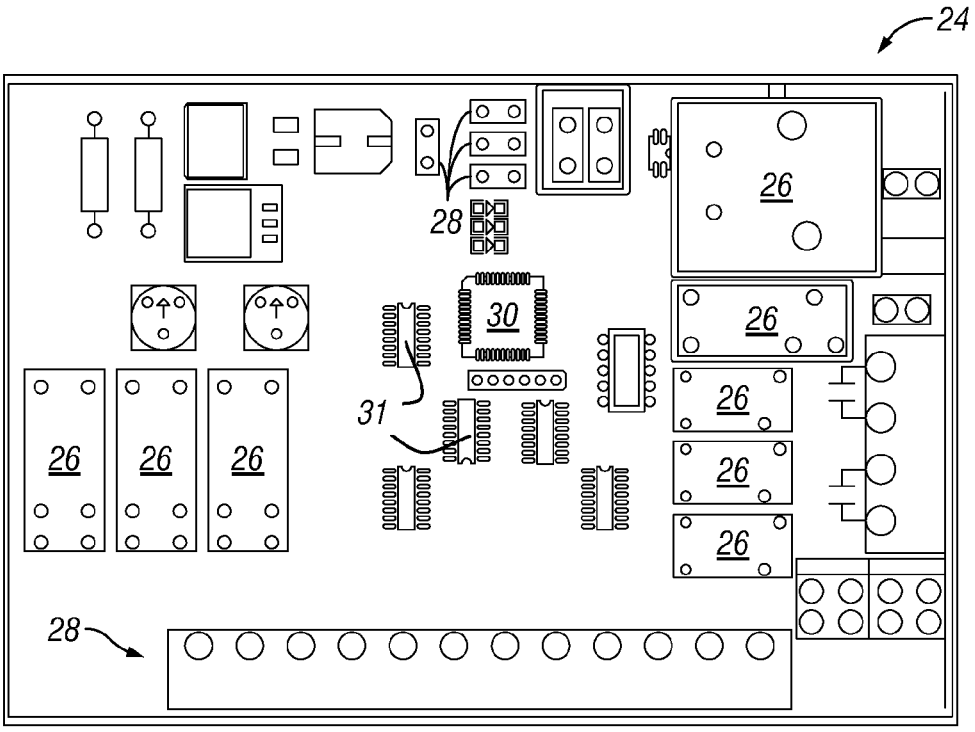
FIG. 2 is a schematic illustration of a motor control board used in the conventional HVAC system shown in FIG. 1.
Figure 4:
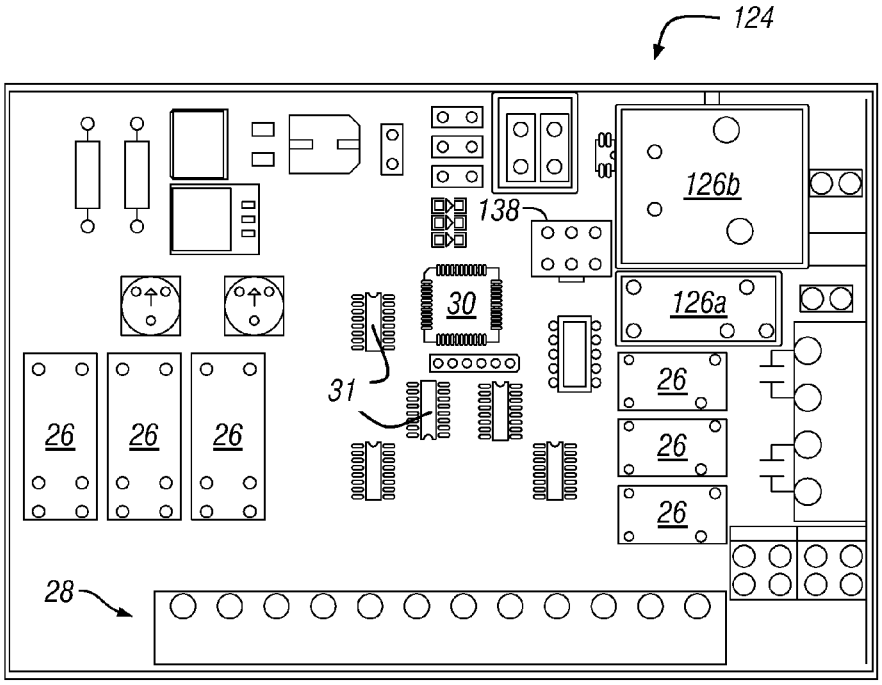
FIG. 4 is a schematic illustration of the airflow control board shown in FIG. 3.

Referring to FIG. 4, wherein like components have like numbers to those components described above with reference to FIG. 2, the airflow control board 124 includes relays 126*a*, 126*b* for selectively providing current to the motors of the compressor and of the high-velocity blower 116, respectively. The airflow control board also includes input jacks for receiving sensor data and control signals, control jacks including a damper control jack 138 for sending a position command signal to an actuator 150 of the air control module 136, and a processor 30 electrically connected to the relays, the input jacks, and the control jacks. The processor is configured, according to an air control algorithm, for receiving sensor data (including, by way of example, measured room temperatures, refrigerant temperatures and/or pressures, and motor winding currents) and control signals (including, by way of example, room temperature and/or refrigerant temperature setpoints). The processor is further configured, according to the air control algorithm, for generating control signals to operate the compressor, the high-velocity blower, and the air control module based on the received sensor data and the received control signals.

In particular, the processor 30 is configured by the air control algorithm to generate the command signal to the air control module actuator 150 for adjusting the position of a damper blade 146 housed in the air control module 136. By adjusting the damper blade to regulate airflow through the HVAC unit 2, the processor modulates electric power consumption by the motor of the high-velocity blower 116.

The air control algorithm can be implemented in the processor 30 via software, in printed, wired, or self-programmable analog or digital circuitry attached to the processor, or in any combination of software and circuitry. Details of the air control algorithm can be developed by those of ordinary skill in view of the HVAC unit design specifications and further in view of the disclosures provided herein.

Figure 5:
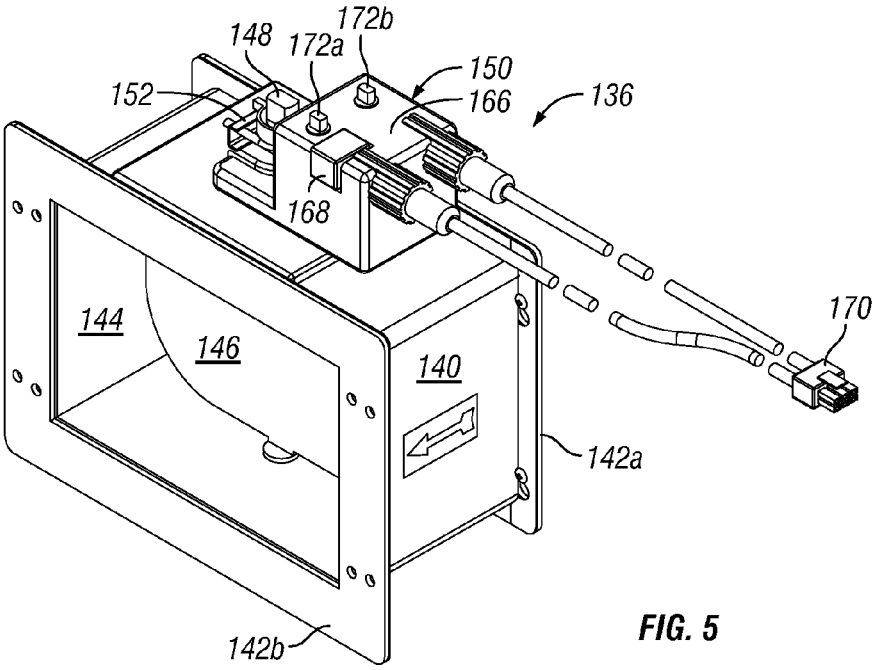
FIG. 5 is a perspective view of the air control module shown in FIG. 3.

Referring to FIG. 5, the air control module 136 includes a casing 140 having inlet and outlet flanges 142*a*, 142*b*. The casing encloses a passage 144, across which the damper blade 146 is pivotally mounted. The damper blade is pivotally connected to the casing by way of a shaft 148 driven by an actuator 150, which is mounted to the casing. The shaft is driven by the actuator through a universal clamp 152, and is movable by the actuator from a minimum-flow angular position 154*a*, wherein the damper blade substantially blocks airflow through the passage, to a maximum-flow angular position 154*b*, wherein the damper blade permits airflow through the passage, as shown schematically in FIG. 3.

Figure 6:
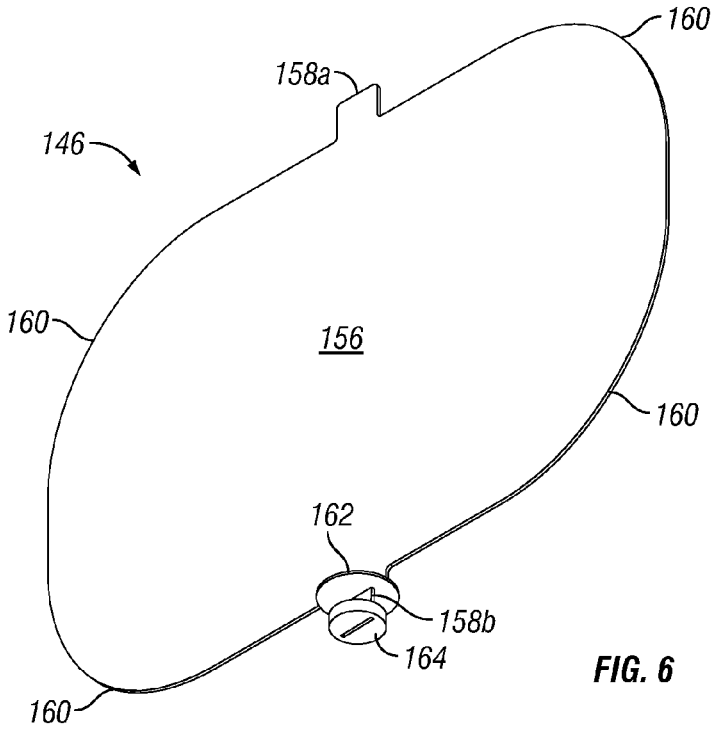
FIG. 6 is a detail view of a damper blade in the air control module shown in FIG. 5.

Referring to FIG. 6, the damper blade 146 includes a body 156 having upper and lower tabs 158*a*, 158*b*. The body has at least one rounded corner 160, so that even in the minimum-flow angular position 154*a*, the damper blade does not entirely block airflow through the passage 144. For example, the broadest surface of the damper blade 146 may be dimensioned with rounded corners so as to block no more than about eighty four percent (84%) of the passage 144 when the damper blade 146 is pivoted to stand substantially across the passage 144. The upper tab is fitted into a notch cut into the lower end of the shaft 148 so that the damper blade rotates with the shaft. The lower tab passes through a slotted washer 162, which is captured onto the lower tab by a welded plug 164. The welded plug fits into a hole cut in the casing 140, and the slotted washer rests slidingly on the inner surface of the casing so that the damper blade pivots freely within the casing.

Figure 7:
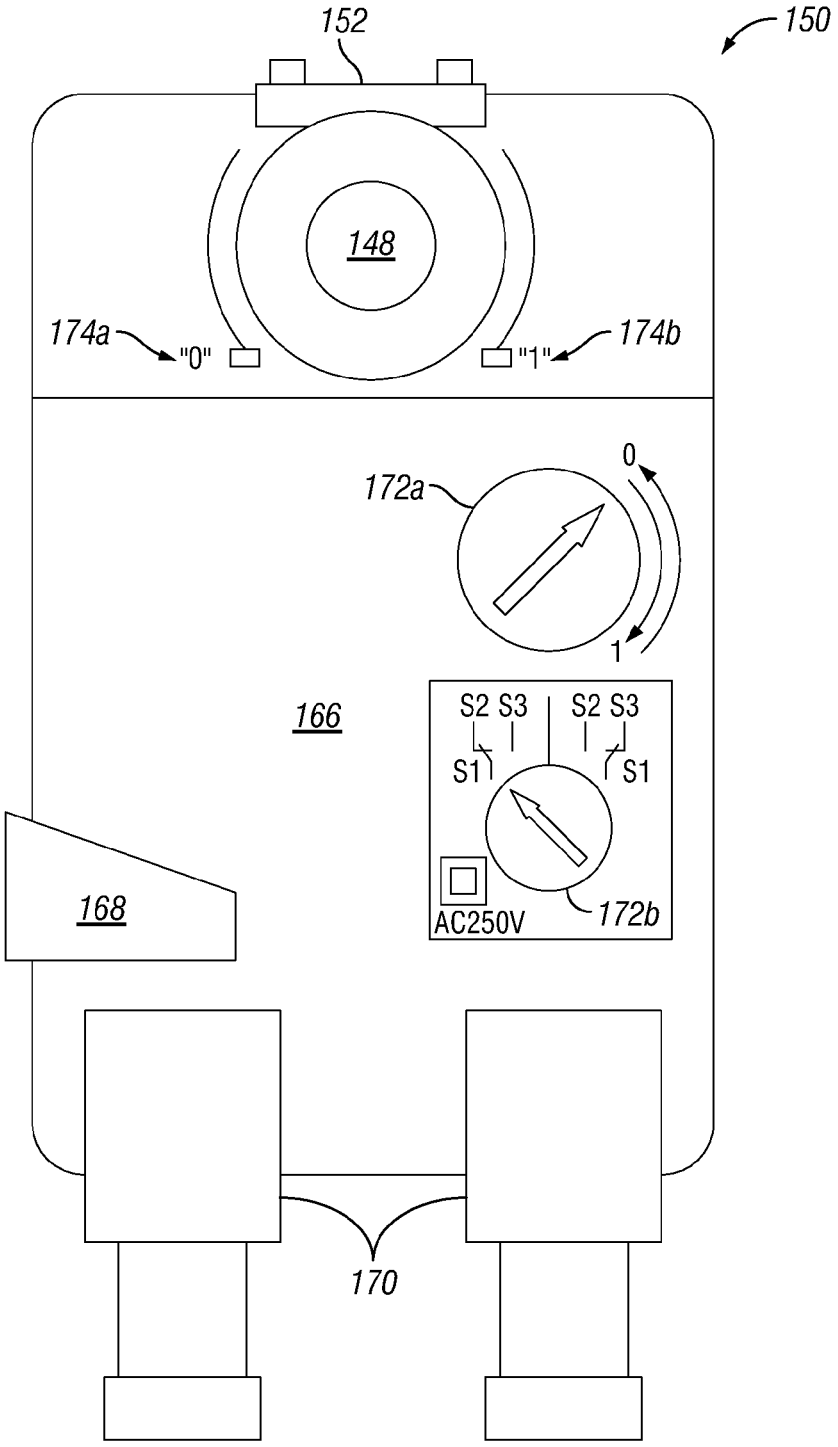
FIG. 7 is a plan view of an actuator connected to the air control module shown in FIG. 5.

Referring to FIG. 7, the actuator 150 includes a geared motor assembly 166, which includes and mechanically connects an electric motor (not shown) to the clamp 152 via a clutch (not shown) operable by a manual override button 168. The geared motor assembly operates according to position control signals received via a cable harness 170, which also provides electric current to power the motor of the geared motor assembly. Preferably, response of the geared motor assembly to the position control signals can be configured by operation of switches 172*a*, 172*b* provided on the geared motor assembly. For example, a Belimo™ two position actuator, model number LBM24-3-S, can be used in the present invention.

Still referring to FIG. 7, while the clutch is engaged, the geared motor assembly is operable to move the clamp between a zero stop 174*a* and a full stop 174*b*. The clamp is rigidly connected to the shaft 148 so that the zero stop delimits the clamp range of travel at the minimum-flow angular position 154*a* of the damper blade 146, while the full stop delimits the clamp range of travel at the maximum-flow angular position 154*b* of the damper blade. The zero stop and the full stop are releasably adjustable relative to the geared motor assembly and the clamp. For example, the stops can be secured to the geared motor assembly by threaded fasteners, which can be loosened for repositioning the stops relative to the clamp.

When the clutch is disengaged by pressing the manual override button 168, the clamp 152 can be freely rotated for manually setting the clamp position relative to the geared motor assembly 166. For example, before assembly of the air control module 136 with the high-velocity HVAC unit 102, the clamp can be manually positioned to the full stop 174*b*. The clamp then can be loosened from the shaft 148. With the clamp loosened, the damper blade 146 can be manually positioned to extend approximately along the passage 144 (default setting for the maximum-flow angular position 154*b*). The clamp then can be tightened to register the default maximum-flow angular position of the damper blade with the full stop of the geared motor assembly.

With the clamp 152 tightened on the shaft 148, and with the air control module 136 installed onto the high-velocity HVAC unit 102, the clutch is disengaged by pressing the manual override button 168, and the cable harness 170 is disconnected from the airflow control board 124. The damper blade 146 then can be manually adjusted to establish setpoints for the electric current drawn by the motor of the high-velocity blower 116 in response to various conditions sensed at the airflow control board. The damper blade is manually adjusted for establishing the setpoints by actuating the high-velocity blower via the airflow control board 124, and monitoring the electric current supplied to the high-velocity blower motor via the airflow control board.

For adjusting the damper blade 146 to an installation-specific setpoint of the maximum-flow angular position 154*b*, the manual override button 168 is pressed and the damper blade is manually rotated until the electric current supplied to the high-velocity blower motor reaches a desired high-flow value. The manual override button then is released, so that the shaft 148 is held in place by the geared motor assembly 166, and the full stop 174*b* is adjusted to contact the clamp 152. To adjust the damper blade to an installation-specific setting of the minimum-flow angular position 154*a*, the manual override button is pressed and the damper blade is manually rotated until the electric current supplied to the high-velocity blower motor reaches a desired low-flow value. The manual override button then is released, so that the shaft is held in place by the geared motor assembly, and the zero stop 174*a* is adjusted to contact the clamp.

Once the damper blade 146 has been adjusted to installation-specific angular position settings, power is secured from the airflow control board 124. The cable harness 170 of the actuator 150 then is electrically connected to the control jack 138 of the airflow control board, and power is restored to the airflow control board for normal operation of the high-velocity HVAC unit 102.

Figure 8:
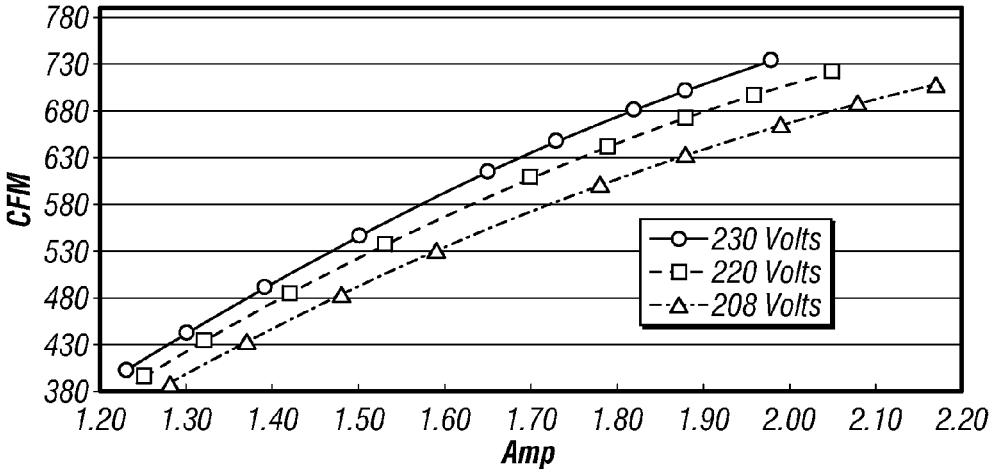
FIGS. 8-10 are graphs of high-velocity blower motor current relative to air control module throughflow.
Figure 9:
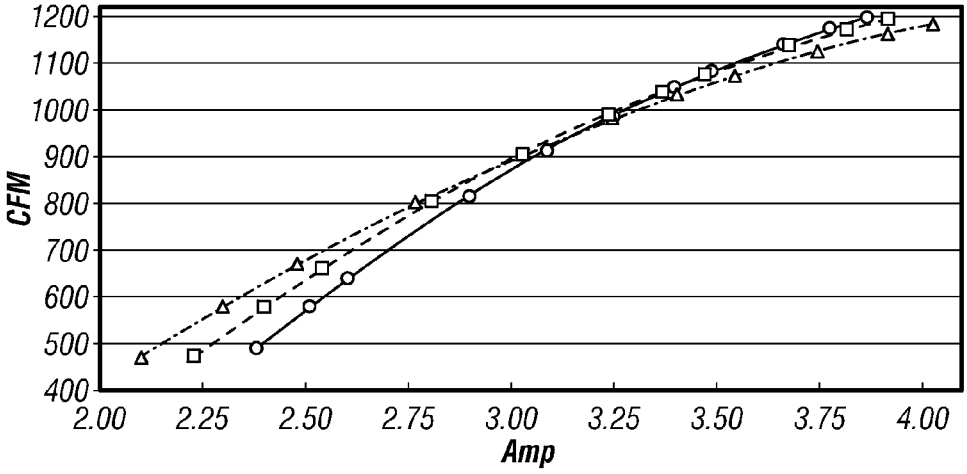
Figure 10:
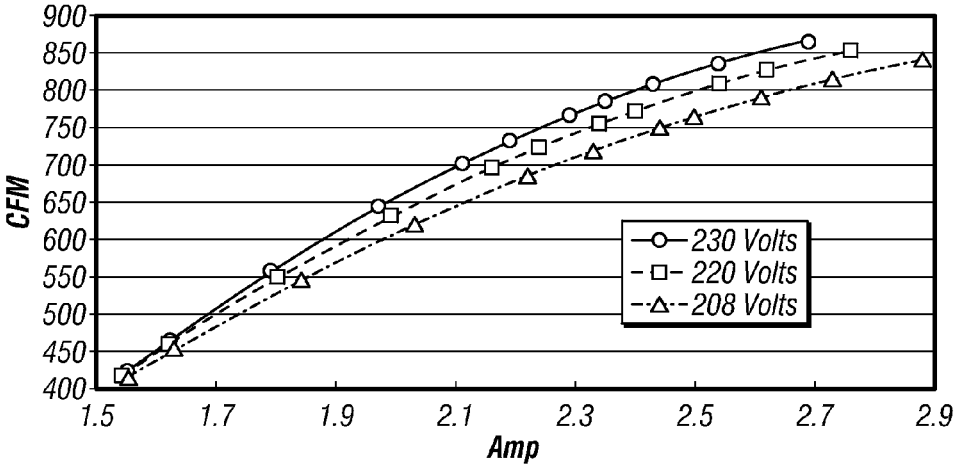

In normal operation, the airflow control board 124 regulates speed of the high-velocity blower 116, and electric current draw of the high-velocity blower motor, by controlling the actuator 150 to adjust angular position of the damper blade 146 within the air control module 136. The air control module is positioned with reference to the high-velocity blower so that the speed of the high-velocity blower, and the electric current through the high-velocity blower motor, is highly responsive to volumetric airflow (CFM) through the air control module, as shown in FIGS. 8-10. Thus, pivoting the damper blade toward the minimum-flow angular position 154*a* speeds the high-velocity blower and reduces the electric current drawn by the high-velocity blower motor by reducing volumetric airflow through the air control module. Pivoting the damper blade toward the maximum-flow angular position 154*b* increases volumetric airflow through the air control module, slowing the high-velocity blower and increasing the electric current drawn by the high-velocity blower motor. The position of the damper blade is selected by the processor according to the air control algorithm, for example based on a calculated difference between room temperature sensor data and a corresponding room temperature control signal.

Preferably, the air control module 136 is positioned so that the shaft 148 is within a distance D downstream from the high-velocity blower 116. The distance D can be determined based on the cross-sectional area of the passage 144 enclosed by the air control module casing 140 and based on the full-current rated volumetric airflow of the high-velocity blower.

The damper blade 146 can be manufactured from any non-corrosive material capable of receiving a smooth surface finish. Preferably, the damper blade body, the slotted washer, and the plug are individually stamped from a 304 stainless steel sheet and are assembled together with the plug being tack welded to the lower tab of the damper blade. Other acceptable materials for the damper blade include, for example, metals such as aluminum, or various polymers such as vinyls, nylons, tetrafluoroethylenes. The damper blade is manufactured with stiffness and mass sufficient to prevent vibrational coupling of the damper blade to the air flowing through the casing 140, thereby mitigating ventilation noise otherwise induced in the ductwork 22 by the high-velocity HVAC unit 102.

Advantageously, the present invention permits controlling the electric current consumption by a high-velocity blower motor by mechanically throttling volumetric airflow through a high velocity blower. The present invention also mitigates ventilation noise at maximum and reduced airflows through a high velocity HVAC unit.

Although this invention has been shown and described with respect to the detailed embodiments thereof, it will be understood by those skilled in the art that various changes in form and detail thereof may be made without departing from the spirit and the scope of the invention.

What is claimed is:

1. A mechanically-modulated ventilation unit apparatus comprising:

a high-velocity blower having an intake, an exhaust, an impeller disposed to ventilate air from the intake to the exhaust, and an electric motor operatively connected to drive the impeller;

an air control module having a casing enclosing a flow passage that defines a flow axis extending from an inlet flange of the casing to an outlet flange of the casing, a blade pivotally mounted within the casing and movable between a plurality of positions each obstructing a different portion of the flow passage, and an actuator operatively connecting the blade to the casing for moving the blade to one of the plurality of positions in response to a command signal received at the actuator;

said air control module and said blower being arranged such that said blower ventilates the flow passage of said air control module;

wherein electric power consumption by the electric motor of said high-velocity blower is modulated solely by movement of the blade within said air control module;

wherein the broadest surface of the blade of said air control module has a generally rectangular shape with rounded corners and has a height and width that substantially corresponds to a height and width of the flow passage; and wherein the blade obstructs about 84% of the flow passage when the blade is positioned perpendicular to the flow passage of the casing, the rounded corners of the blade permitting the flow passage to remain about 16% unobstructed when the blade is positioned perpendicular to the flow passage of the casing.

2. The apparatus according to claim 1, wherein the pivot axis of the blade of said air control module is disposed at a flow distance D from the impeller of said blower, the flow distance D being determined as a function of the cross-sectional flow area of the flow passage and of the full-current rated volumetric airflow of said blower.

3. The apparatus according to claim 1, wherein the blade of said air control module is pivoted in bearings housed in opposed walls of the casing of said air control module.

4. The apparatus according to claim 1, wherein the blade of said air control module is generally elliptic in shape, having flattened ends and sides conforming to the casing of said air control module.

5. The apparatus according to claim 1, further comprising:

a refrigeration system including a compressor, an evaporator, an expansion valve, and a condenser, wherein said blower is disposed to ventilate at least one of the evaporator and the condenser of said refrigeration system.

6. The apparatus according to claim 1, further comprising: a processor in communication with the actuator of said air control module, said processor configured to receive sensor data and further configured to generate and send to the actuator a command signal based on parameters including at least the received sensor data and at least one control signal related to the received sensor data, wherein the command signal represents a modulated flow position of the blade of said air control module, selected from a range of positions between a maximum-flow position and a minimum-flow position.

7. The apparatus according to claim 6, wherein the parameters for generating the command signal further include at least a full-current rated flow of a blower connected to direct air through the passage and a distance from said blower to said damper blade.

* * * * *